US006138719A

United States Patent [19]

Kerner et al.

[11] Patent Number: 6,138,719

[45] Date of Patent: Oct. 31, 2000

[54] AUXILIARY BLOW NOZZLE FOR AN AIR JET WEAVING MACHINE

[75] Inventors: Horst Kerner, Lindenberg; Hubertus Ludwig, Lindau, both of Germany

[73] Assignee: Lindauer Dornier Gesellschaft mbH, Lindau, Germany

[21] Appl. No.: 09/341,743

[22] PCT Filed: Nov. 18, 1998

[86] PCT No.: PCT/DE98/03412

§ 371 Date: Jul. 14, 1999

§ 102(e) Date: Jul. 14, 1999

[87] PCT Pub. No.: WO99/27171

PCT Pub. Date: Jun. 3, 1999

[30] Foreign Application Priority Data

Nov. 20, 1997 [DE] Germany ..... 197 51 354

[51] Int. Cl.[7] ..... D03D 47/30

[52] U.S. Cl. ..... 139/435.5; 226/97.4; 239/589.1

[58] Field of Search ..... 226/97.4; 239/589.1; 139/435.5

[56] References Cited

U.S. PATENT DOCUMENTS

| | | | |
|---|---|---|---|
| 3,978,896 | 9/1976 | Larmit | 139/1 C |
| 4,987,930 | 1/1991 | Okesaku et al. . | |
| 5,649,571 | 7/1997 | Miyahara et al. | 139/435.5 |
| 5,857,606 | 1/1999 | Tseng | 226/97.4 |

FOREIGN PATENT DOCUMENTS

| | | |
|---|---|---|
| 0145824 | 6/1985 | European Pat. Off. . |
| 2740108 | 3/1978 | Germany . |
| 29720595 | 3/1998 | Germany . |
| 650035 | 6/1985 | Switzerland . |
| 656905 | 7/1986 | Switzerland . |

*Primary Examiner*—Andy Falik
*Attorney, Agent, or Firm*—W. F. Fasse; W. G. Fasse

[57] ABSTRACT

The invention relates to an auxiliary blow nozzle for air jet weaving machines which permits a symmetric division of the warp, said division protecting the structure of the warp threads, when the blow nozzle is immersed in the warp. To this end, an envelope curve (5) which describes the free end (1*b*) of the nozzle body (1) and which has a radius ($R_1$) runs at an angle ($\alpha$) relative to the longitudinal axis (4*a*) of the approximately elliptic cross-section of a nozzle body end area (1*a*). The surfaces (6, 7) originating from the envelope curve (5) slope downward on both sides to the outer periphery (4) in a manner similar to a roof, and said surfaces (6, 7) thus enclose an angle ($\beta$). The respective surface (6, 7) having a radius ($R_2$) graduates into the outer periphery (4). A radius ($R_3$) connects radius ($R_1$) of the envelope curve (5) to the outer periphery (4), and each surface (6, 7) constructs an arc-shaped surface section (6*a*, 7*a*) which slopes downward at an angle ($\gamma$) relative to the outer periphery (4). The graduations of said surface sections into the adjacent surfaces (6, 7) and into the outer periphery (4) are rounded.

8 Claims, 4 Drawing Sheets

AUXILIARY BLOW NOZZLE FOR AN AIR JET WEAVING MACHINE

BACKGROUND OF THE INVENTION

1. Field of the Invention

The invention relates to an auxiliary blow nozzle for an air jet weaving loom. Such auxiliary nozzles have an air flow channel with an entrance opening and a nozzle end section with an exit opening.

2. Description of the Related Art Including Information Disclosed in an Information Disclosure Statement U.S. Pat. 4,987,930 discloses an auxiliary blow nozzle wherein the exit opening in the nozzle end section has a longitudinal central axis angled relative to a longitudinal central axis of the air flow channel. The known nozzle further includes a longitudinal section extending from said nozzle end section toward said entrance opening, said longitudinal section having an approximately elliptically formed outer circumference, an envelope curve reaching partially around said longitudinal central axis of said exit opening. The envelope curve defines the free end of said nozzle end section. The envelope curve has a radius $R_1$, whereby the envelope curve is rounded toward neighboring surfaces.

Auxiliary blow nozzles having the above known features, are used in air nozzle weaving looms. The longitudinal axis of the exit opening for the air stream extends rectangularly to the extension of the envelope curve of the free end of the auxiliary blow nozzle or rectangularly to the longitudinal central axis of the approximately elliptical outer circumference of the nozzle body. Such a construction requires for the use of the auxiliary blow nozzle in practice that for an optimal effectiveness of the air stream on the weft thread to be inserted into the weft insertion channel of a reed, the longitudinal central axis of the exit opening is tilted at an angle of a few angular degrees in the horizontal plane relative to the warp threads of a weaving warp, or is directed at a few angular degrees toward the weft insertion channel of the reed. However, such an alignment has the disadvantage that during the immersion of the auxiliary blow nozzles into the lower shed of a weaving warp, not all concerned warp threads, which are touched or even briefly lifted by the free end of the nozzle, slide off symmetrically from this free nozzle end. Such an alignment further means that the repeated immersion of the auxiliary blow nozzles, which is a technical condition of weaving, into the lower warp, leads to damaging of the respective warp threads, when the longitudinal axis of the approximately elliptical outer circumference is not aligned in parallel to the course of the warp threads. These damages are noticeable in the produced fabric and eventually appear as weaving faults in the fabric.

Auxiliary blow nozzles are further known from European Patent Publication EP 0,145,824, which also have a structural assembly as described above. The known nozzle has a structurally fixed, longitudinal central axis of its exit opening which is angled relative to the course of the envelope curve, which forms the free end of the nozzle body, or relative to the longitudinal axis of the approximately elliptical cross-section of the nozzle body. The elliptical cross-section is congruent to the envelope curve. Such a known construction aims at achieving the following:

(a) an optimal effectiveness of the air stream on the weft thread, and (b) an optimal adaptation of the outer contour of the nozzle body end section to the course of the warp threads.

However, such a known construction still has a disadvantage in that the longitudinal central axis of the exit opening extends at an angle of more than 90° to the longitudinal axis of the elliptical form of the nozzle body end section. That means that it is more difficult to produce the exit opening, compared to an exit opening aligned at a right angle to the longitudinal axis of the elliptical outer circumference.

OBJECT OF THE INVENTION

In view of the above background it is the object of the invention to provide an auxiliary blow nozzle, particularly for air jet weaving looms, which makes possible a symmetric, gentle dividing of the weaving warp when entering into the lower weaving warp shed.

SUMMARY OF THE INVENTION

The nozzle of the invention is characterized by the following features. According to the invention there is provided an auxiliary blow nozzle for an air jet weaving loom, comprising an air flow channel having a longitudinal central channel axis and an entrance opening at one end of said channel for connection to a fluid supply, a nozzle end portion at the other end of said air flow channel, an exit opening in said nozzle end portion, said exit opening having a central opening axis angled relative to said longitudinal central channel axis, said nozzle further including a longitudinal nozzle section extending from said nozzle end portion toward said entrance opening, said longitudinal section having an outer circumferential wall with an oval cross-section, said nozzle end portion comprising a free end wall having an envelope curve reaching partially around said central opening axis of said exit opening, said envelope curve having a first radius, said free end wall including wall portions merging with a rounding into said envelope curve, wherein said envelope curve extends at a first angle ($\alpha$) to a major axis of said oval cross-section of said outer circumferential wall, wherein said wall portions extending from said envelope curve slope downwardly on both sides as a roof toward said outer circumferential wall, whereby said wall portions enclose a second angle ($\beta$) and merge into said outer circumferential wall with a second radius ($R_2$), wherein a third radius ($R_3$) connects said first radius ($R_1$) of said envelope curve with said outer circumferential wall, and wherein each wall portion has a bow shaped wall segment which slopes downwardly at a third angle ($\gamma$) toward said outer circumferential wall, said bow shaped wall segments having rounded transitions to neighboring surfaces and to said outer circumferential wall.

Due to the construction of the end section of the auxiliary blow nozzle according to the invention it is achieved in an advantageous manner that the group of warp threads, which is affected by the entrance of the auxiliary blow nozzle into the lower weaving warp, is divided symmetrically, without any impairment whatsoever of the structure of the respective warp threads.

BRIEF DESCRIPTION OF THE DRAWINGS

In the following the invention will be explained with reference to an example embodiment illustrated in the accompanying drawings, wherein.

DETAILED DESCRIPTION OF THE INVENTION

Figure 1:
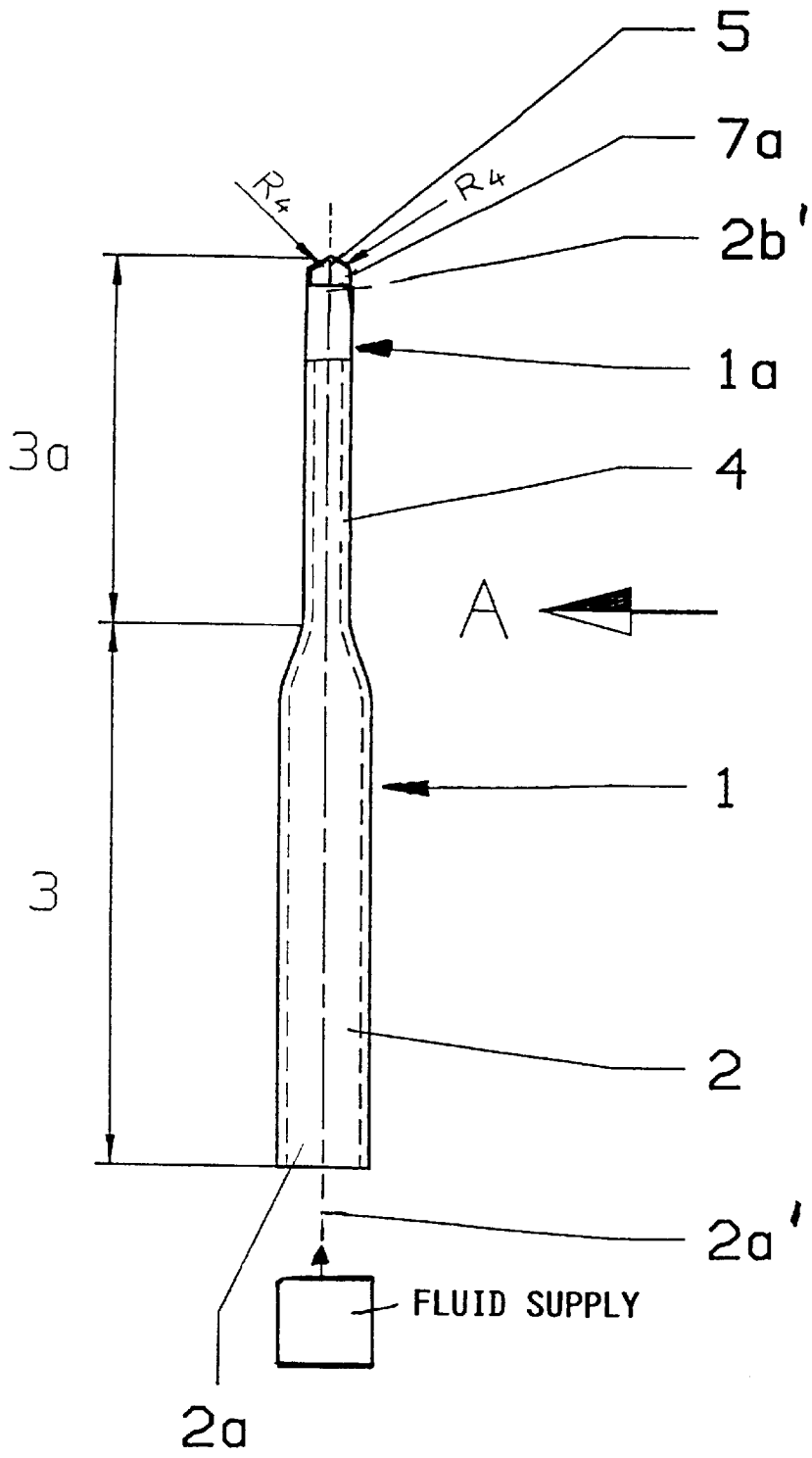
FIG. 1 shows a side view of the present auxiliary blow nozzle on a scale of about 3:1.

According to FIG. 1 the present auxiliary blow nozzle 1 comprises a tubular body 2 having a first longitudinal section 3 with, for example, a circular cross-section, an air entrance opening 2*a*, and a second longitudinal section 3*a* having an approximately elliptical or oval cross-section. An exit opening 2*b* is worked into the wall of the elliptical cross-section of an end portion 1*a* of the second longitudinal section 3*a*.

Figure 2:
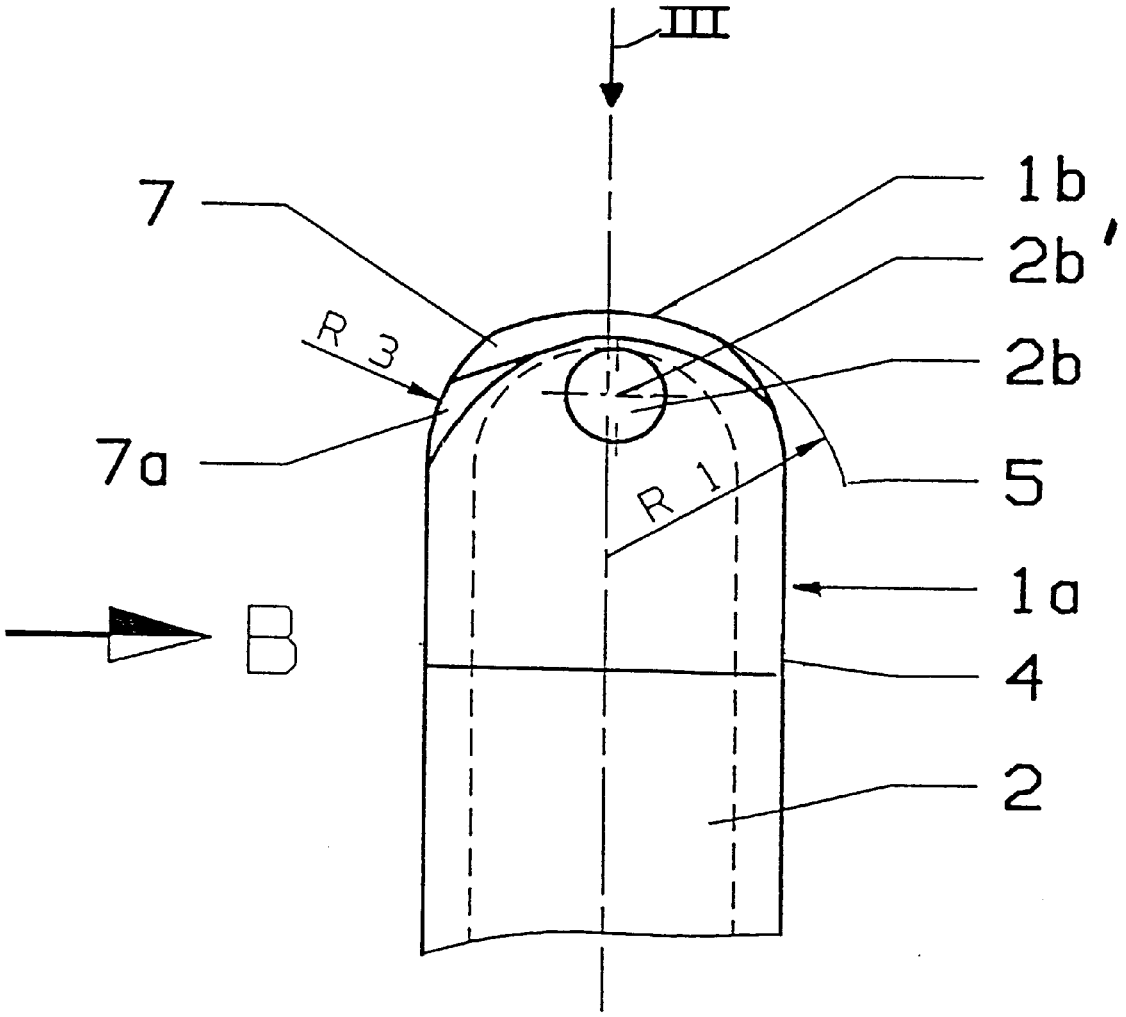
FIG. 2 shows the end section of the present auxiliary blow nozzle in the direction of the arrow A shown in FIG. 1.
Figure 3:
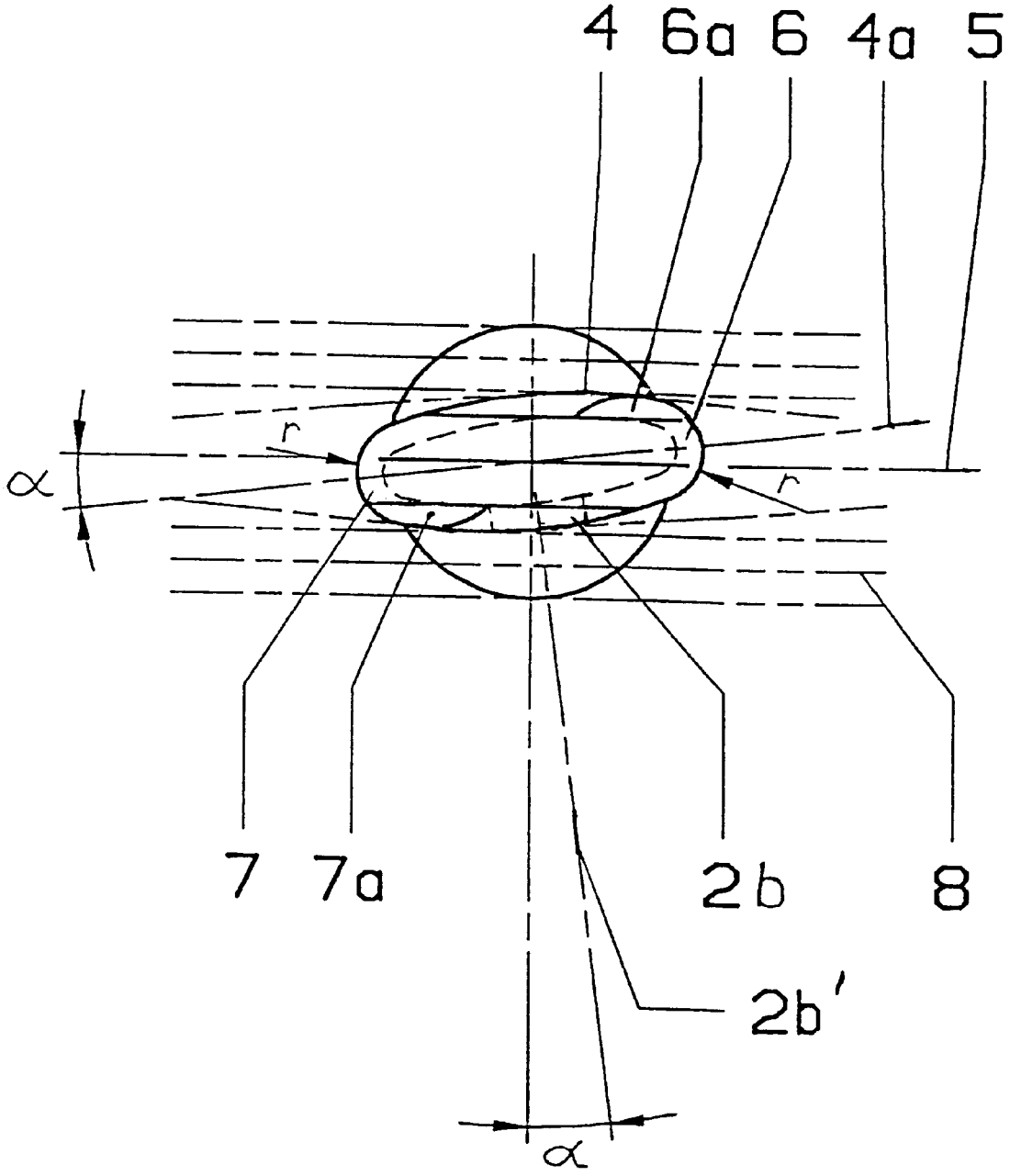
FIG. 3 shows a plan view of the present auxiliary blow nozzle in the direction of the arrow III in FIG. 2.
Figure 4:
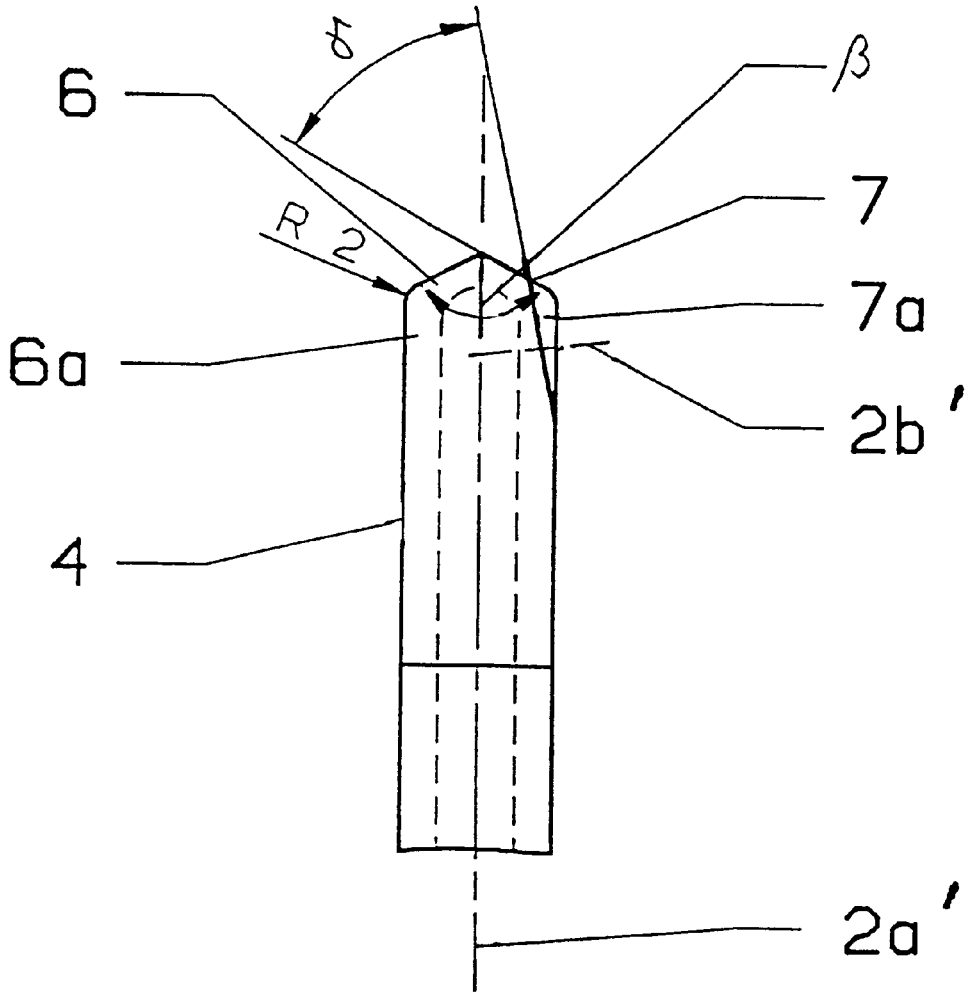
FIG. 4 shows the end section of the present auxiliary blow nozzle in the direction of the arrow B shown in FIG. 2.

The features of the auxiliary blow nozzle 1 according to the invention are shown in FIGS. 2 to 4 on an enlarged scale compared to FIG. 1.

FIG. 2 shows the end portion 1*a* of the auxiliary blow nozzle 1 in the direction of the arrow A in FIG. 1. The free end 1*b* of the end portion la is enclosed by an end wall formed as an envelope curve 5 as is known as such. The envelope curve 5 has a first radius $R_1$, which is larger than or equal to 3700 $\mu$m ($R_1 \geqq 3700 \mu$m).

Relative to the prior art, the following features are essential to the invention, namely:

that the envelope curve 5 extends at a first angle $\alpha \geqq 3°$ (angular degrees) relative to the longitudinal axis 4*a* of the approximately elliptical or oval cross-section, see also FIG. 3;

that a third radius $R_3$, of about 1000 $\mu$m connects the first radius $R_1$ of the envelope curve 5 with an outer circumferential wall 4 of the end portion 1*a*;

that a first surface or wall portion 6 and a second surface or wall portion 7 extending from the envelope curve 5, are formed in the manner of a roof on both sides, both said roof surfaces enclosing a second angle $\beta$ of about 120° (angular degrees) with a second radius $R_2 \geqq 300$ $\mu$m. Both wall portions 6,7 merge into the outer circumferential wall 4; and that each surface or wall portion 6, 7 forms a vaulted surface or wall segment 6*a*, 7*a* sloping at a third angle $\gamma \geqq 50°$ (angular degrees) relative to the radius r of the outer circumferential wall having an elliptical or oval cross-section 4, and wherein transition areas between the vaulted surface segments 6*a*, 7*a* and said surface portions 6, 7 and transition areas between said vaulted surface segments 6*a*, 7*a* and said outer circumferential wall 4 are rounded.

In a further embodiment of the invention the surface portions 6, 7 may be slightly vaulted outwardly or these surface portions 6, 7 may be plane surfaces. The vaulting may thereby have a fourth radius $R_4$ smaller than 1000 $\mu$m.

A multitude of the present auxiliary blow nozzles is arranged on the read stay of an air jet weaving loom not shown. The reed stay carries a reed with a weft insertion channel. The arrangement is such according to the invention that the envelope curve 5 and the surface or wall portions 6 and 7 are positioned exactly in parallel to the warp threads 8 of the weaving warp shed and so that the surface or wall segments 6*a* and 7*a* extend almost in parallel to the warp threads 8, whereby the longitudinal axis 2*b*' of the exit opening 2*b* is aligned at the first angle a $\alpha \geqq 3°$ (angular degrees) to the longitudinal axis of the weft thread insertion channel.

Although the present invention has been described and illustrated in detail, it is clearly understood that the same is by way of illustration and example only and is not to be taken by way of limitation, the spirit and scope of the present invention being limited only by the term of the appended claims.

An auxiliary blow nozzle for air jet weaving machines shaped to assure a symmetric parting of the warp threads forming the lower warp shed, whereby the structure of the warp threads is protected, when the blow nozzle enters into the lower warp shed. To this end, an envelope curve (5) which defines the free end (1*b*) of the nozzle body (1) has a first radius ($R_1$) that runs at a first angle ($\alpha$) relative to the longitudinal axis (4*a*) of a nozzle body end area (1*a*) having an approximately elliptic cross-section. Surfaces (6, 7) originating from the envelope curve (5) slope downwardly on both sides to the outer circumferential nozzle wall (4) in a manner similar to a roof, whereby these roof surfaces (6, 7) enclose a second angle ($\beta$). The roof surfaces (6, 7) merge with a second radius ($R_2$) into the outer circumferential nozzle wall (4). A third radius ($R_3$) connects the first radius ($R_1$) of the envelope curve (5) to the outer circumferential nozzle wall (4). Each roof surface (6, 7) has an arc-shaped surface portion (6*a*, 7*a*) which slopes downwardly at a third angle ($\gamma$) relative to the outer circumferential nozzle wall (4). The transitions of the surface portions (6*a*, 7*a*) into the adjacent surfaces (6, 7) and into the circumferential nozzle wall (4) are rounded.

What is claimed is:

1. An auxiliary blow nozzle for an air jet weaving loom,comprising an air flow channel (2) having a longitudinal central channel axis (2*a*') and an entrance opening (2*a*) at one end of said channel (2) for connection to a fluid supply, a nozzle end portion (1*a*) at the other end of said air flow channel (2), an exit opening (2*b*) in said nozzle end portion (1*a*), said exit opening (2*b*) having a central opening axis (2*b*') angled relative to said longitudinal central channel axis (2*a*'), said nozzle further including a longitudinal nozzle section (3*a*) extending from said nozzle end portion (1*a*) toward said entrance opening (2*a*), said longitudinal section (3*a*) having an outer circumferential wall (4) with an oval cross-section, said nozzle end portion (1*a*) comprising a free end wall having an envelope curve (5) reaching partially around said central opening axis (2*b*') of said exit opening (2*b*), said envelope curve (5) having a first radius ($R_1$), said free end wall including wall portions (6, 7) merging with a rounding into said envelope curve (5), wherein said envelope curve (5) extends at a first angle ($\alpha$) to a major axis (4*a*) of said oval cross-section of said outer circumferential wall (4), wherein said wall portions (6, 7) extending from said envelope curve (5) slope downwardly on both sides as a roof toward said outer circumferential wall (4), whereby said wall portions (6, 7) enclose a second angle ($\beta$) and merge into said outer circumferential wall (4) with a second radius ($R_2$), wherein a third radius ($R_3$) connects said first radius ($R_1$) of said envelope curve (5) with said outer circumferential wall (4), and wherein each wall portion (6, 7) has a bow shaped wall segment (6*a*, 7*a*) which slopes downwardly at a third angle ($\gamma$) toward said outer circumferential wall (4), said bow shaped wall segments (6*a*, 7*a*) having rounded transitions to neighboring surfaces and to said outer circumferential wall (4).

2. The auxiliary blow nozzle of claim 1, wherein said bow shaped wall segments (6*a*, 7*a*) are positioned opposite each other.

3. The auxiliary blow nozzle of claim 1, wherein said wall portions (6, 7) have an outwardly vaulted shape.

4. The auxiliary blow nozzle of claim 1, wherein said wall portions (6, 7) are plane.

5. The auxiliary blow nozzle of claim 1, wherein said first radius ($R_1$) is $\geqq 3700$ $\mu$m, said second radius ($R_2$) is $\geqq 300$ $\mu$m, and said third radius ($R_3$) is about 1000 $\mu$m.

6. The auxiliary blow nozzle of claim 1, wherein said first angle ($\alpha$) is $\geqq 3°$, said second angle ($\beta$) is about 120°, and said third angle ($\gamma$) is <60°.

7. The auxiliary blow nozzle of claim 3, wherein said outwardly vaulted shape of said wall portions (6,7) has a fourth radius ($R_4$) <1000 $\mu$m.

8. The auxiliary blow nozzle of claim 1, wherein said envelope curve (5) and said wall portions (6, 7) are aligned in parallel to warp threads in said air jet weaving loom, whereby said bow shaped wall segments (6*a*, 7*a*) extend approximately in parallel to said warp threads of a weaving warp shed.

* * * * *

UNITED STATES PATENT AND TRADEMARK OFFICE

CERTIFICATE OF CORRECTION

PATENT NO. : 6,138,719
DATED : October 31, 2000
INVENTOR(S) : Kerner et al.

It is certified that error appears in the above-identified patent and that said Letters Patent is hereby corrected as shown below:

Title page,
Under [86] §371 Date, replace "Jul. 14, 1999" by -- Jul. 15, 1999 --;
Under [86] §102© Date", replace "Jul. 14, 1999" by -- Jul. 15, 1999 --;
Under [57] ABSTRACT:
Lines 1 to 19, cancel and replace to read as follows:
-- An auxiliary blow nozzle for air jet weaving machines shaped to assure a symmetric parting of the warp threads forming the lower warp shed, whereby the structure of the warp threads is protected, when the blow nozzle enters into the lower warp shed. To this end, an envelope curve (5) which defines the free end (1b) of the nozzle body (1) has a first radius ($R_1$) that runs at a first angle ($\alpha$) relative to the longitudinal axis (4a) of a nozzle body end area (1a) having an approximately elliptic cross-section. Surfaces (6, 7) originating from the envelope curve (5) slope downwardly on both sides to the outer circumferential nozzle wall (4) in a manner similar to a roof, whereby these roof surfaces (6, 7) enclose a second angle ($\beta$). The roof surfaces (6, 7) merge with a second radius ($R_2$) into the outer circumferential nozzle wall (4). A third radius ($R_3$) connects the first radius ($R_1$) of the envelope curve (5) to the outer circumfrential nozzle wall (4). Each roof surface (6, 7) hs an arc-shaped surface portion (6a, 7a) which slopes downwardly at a third angle ($\gamma$) relative to the outer circumferential nozzle wall (4).The transitions of the surface portions (6a, 7a) into the adjacent surfaces (6, 7) and into the circumferential nozzle wall (4) are rounded.--.

Column 4,
Lines 4 to 25, cancel these entire lines.

Signed and Sealed this

Ninth Day of October, 2001

*Attest:*

Nicholas P. Godici

*Attesting Officer*

NICHOLAS P. GODICI
*Acting Director of the United States Patent and Trademark Office*